US009077156B2

(12) United States Patent
Francesconi

(10) Patent No.: US 9,077,156 B2
(45) Date of Patent: Jul. 7, 2015

(54) SPARK PLUG

(76) Inventor: Christian Francesconi, Kapfenberg (AT)

( * ) Notice: Subject to any disclaimer, the term of this patent is extended or adjusted under 35 U.S.C. 154(b) by 0 days.

(21) Appl. No.: 13/985,320

(22) PCT Filed: Feb. 20, 2012

(86) PCT No.: PCT/AT2012/000036

§ 371 (c)(1),
(2), (4) Date: Aug. 14, 2013

(87) PCT Pub. No.: WO2012/113001

PCT Pub. Date: Aug. 30, 2012

(65) Prior Publication Data

US 2013/0313960 A1 Nov. 28, 2013

(30) Foreign Application Priority Data

Feb. 21, 2011 (AT) ..... A 231/2011

(51) Int. Cl.

| | |
|---|---|
| ***H01T 13/20*** | (2006.01) |
| ***H01T 13/16*** | (2006.01) |
| ***H01T 13/46*** | (2006.01) |
| ***H01T 13/54*** | (2006.01) |

(52) U.S. Cl.
CPC ..... *H01T 13/16* (2013.01); *H01T 13/467* (2013.01); *H01T 13/54* (2013.01)

(58) Field of Classification Search
CPC ..... H01T 13/20
USPC ..... 313/140–141
See application file for complete search history.

(56) References Cited

FOREIGN PATENT DOCUMENTS

EP 1265329 A1 * 12/2002

* cited by examiner

*Primary Examiner* — Mary Ellen Bowman
(74) *Attorney, Agent, or Firm* — Dennemeyer & Associates, LLC

(57) ABSTRACT

The invention relates to a spark plug of an internal combustion engine, preferably for spark-ignition gas engines, comprising a spark plug housing that surrounds an insulating body and comprising a center electrode and at least one ground electrode supported by a ground electrode carrier, wherein the ignition surface of the center electrode and the ignition surface of the ground electrode are surrounded by a wall, which forms a chamber open on the combustion chamber side. According to the invention, the ground electrode carrier, as viewed perpendicularly to the longitudinal axis (A) of the spark plug, is spaced further apart from the center electrode than the outer surface of the wall of the chamber therefrom and supports at least one finger-shaped ground electrode, which extends into the chamber through an opening in the wall, wherein the ignition surface of the ground electrode lies at the same height as the ignition surface of the center electrode in the chamber.

20 Claims, 4 Drawing Sheets

SPARK PLUG

Figure 1:
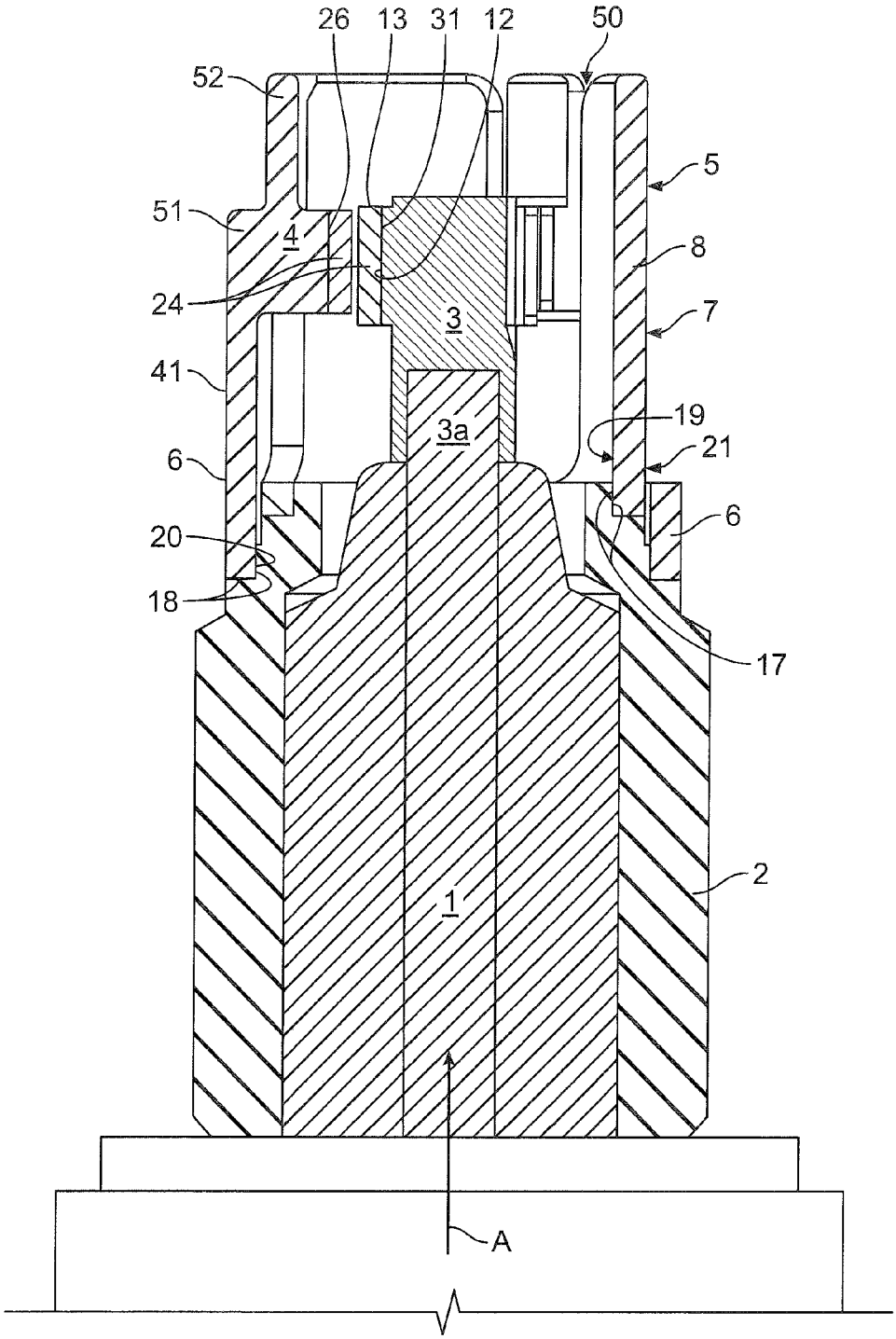

This invention relates to a spark plug according to the preamble of patent claim 1.

Such spark plugs are known from WO 2009/059339 A1.

The object of the invention is to simplify manufacturing of such spark plugs, in particular in view of avoiding complex components which are complicated to make, and the spark plug consisting of parts that are easy to make. This is important in particular for mass production. Moreover, the electrical properties of such spark plugs are to be at least equivalent to those of comparable spark plugs, or even exceed such properties. Consequently, optimal current conduction across the individual ground electrodes has to be provided. Finally, ignition properties are to be improved, preferably by optimizing thermal conductivity and heat dissipation from the ignition surfaces in order to obtain better stability.

In a spark plug of the type mentioned in the beginning, these objects are achieved by the features detailed in the characterizing part of claim 1.

Arranging the ground electrodes on a carrier of their own will guarantee constant current conduction across the ground electrodes. As the ground electrode carrier is arranged at a distance from the wall of the chamber, the ground electrodes and the ground electrode carrier are a system which is independent regarding current and heat conduction from the wall of the chamber. This allows for easy adjusting of the ground electrodes, and operational electrode consumption is easy to correct. Due to the possibility for the ground electrode carrier and the ground electrodes to be produced discretely, in particularly as an integral component, considerable manufacturing advantages will result. Also, since the ground electrodes can be made as an integral component with the ground electrode carrier, and there is clearance between the ground electrode carrier and the wall of the chamber, improved heat dissipation from the spark electrodes to the spark plug housing is obtained. The specific shape of the ground electrodes and the arrangement thereof result in further advantages regarding improved ignition performance and shielding or conduction of the chamber.

Particularly simple production with stable construction of the spark plug is achieved by the specific shape of the ground electrode carrier. The ground electrode carrier having a cross-section in the form of a cylinder ring is easy to adjust with circumferentially constant clearance from the outer surface of the wall of the chamber so that defined conditions will result regarding combustion and current conduction. Moreover, construction and installation of the spark plug are facilitated because the ground electrode carrier in the form of a cylinder ring and also the chamber having a cross-section in the form of a cylinder ring can be easily placed on the spark plug housing and secured thereto. Advantageous fastening can be achieved if the ground electrode carrier and the wall are supported by the spark plug housing or an end part arranged at the end region on the combustion chamber side of the spark plug housing. On the inner wall surface thereof, the ground electrode carrier can be embodied with a thread, or else have a smooth surface; the same applies for the wall of the chamber. Either the ground electrode carrier or the wall of the chamber is screwed on the respective protruding end shoulders of the spark plug housing or the end part and/or it is fixed in place by welding, or said components are slipped onto the spark plug housing or the end part with the best possible fit and fixed in the desired position, in particular by welding.

Provision can be made for two concentrically located, cylindrical end shoulders to be made on the spark plug housing or the end part, the interior end shoulder of which could project from the exterior end shoulder toward the combustion chamber, wherein the ground electrode carrier is placed, slipped, or screwed on, and/or secured by welding, possibly spot or seam welding, to the exterior end shoulder, and the wall of the chamber to the interior end shoulder, respectively. It is advantageous for the end part to be made integral with the wall, with the ground electrode carrier being placed, slipped, or screwed on, and/or secured by welding, possibly spot or seam welding, to the end part and/or the spark plug housing. Thereby, manufacturing of the spark plug is simplified, and the spark plug housing is made longer for the same total spark plug length. For the same overall length of the spark plug, improved heat dissipation from the ground electrode and the wall into the spark plug housing results, and the risk of self-ignition is reduced.

Simple construction of the spark plug and stable design will result if the ground electrode carrier is arranged while creating clearance from the outer surface of the wall and at least partially surrounding the same, and carrying at least one finger-shaped ground electrode extending through an opening in the wall of the chamber into the chamber, and advantageously, the ignition surface of the ground electrode is located at the height of the ignition surface of the center electrode inside the chamber.

With regard to manufacturing, advantages will result if the ground electrode carrier has a circular cross-section as seen perpendicularly to the longitudinal axis of the spark plug, or if it is formed by a cylinder ring and/or the at least one ground electrode and the ground electrode carrier are made integrally or are connected to one another by welding.

With respect to heat resistance of the spark plug, it is advantageous if through-openings for passing ignited gas jets or the fresh gas mixture are made in the wall.

For operation of the spark plug, advantages will result if the ground electrode carrier carries one, three, or five ground electrodes, and/or if the ground electrodes are distributed around the ground electrode carrier evenly spaced with respect to each other, and/or if each of the ground electrodes branching off from the ground electrode carrier has at least in partial regions of the longitudinal extension thereof a cross-section in the form of a rectangle or cylinder ring section, and/or if the ignition gap is made between surface areas opposite each other and extending in parallel to the longitudinal axis of the ground electrode and the center electrode.

Simple construction will result if on the concentrically located end shoulders of the spark plug housing or the end part, respectively one external thread is made, and on the inner wall surface of the wall and/or the inner wall surface of the ground electrode carrier, respectively one internal thread matching the respective external thread is made, and/or if the ground electrode carrier and the wall in the form of a cylinder ring are arranged concentrically with respect to each other while creating the specified clearance, and/or the cylindrical wall and/or the ground electrode carrier is/are slipped on the respective end shoulder and secured thereto by welding.

For the construction of the spark plug, in particular with respect to current and heat conductivity or heat dissipation, it is advantageous if a number of slots extending in the direction of the longitudinal axis of the spark plug, preferably extending in parallel, is made in the wall, guiding the ground electrodes into the inside of the chamber, with the slots possibly extending from the front surface of the wall on the combustion chamber side up to the level of the front side of the interior end portion of the spark plug housing or end part.

Thus, according to the invention, the carriers or bodies of the ground electrodes extend outside the wall and protrude with the portion thereof located on the combustion chamber side through the longitudinal slots into the chamber delimited by the wall. Thereby, the ground electrodes also have a shielding effect, and between the ground electrodes and the adjacent slot wall surfaces, some desired gas circulation can be maintained which helps with cooling of the electrodes. Thus, excessive heat accumulation is avoided and self-ignition is countered.

For ignition and heat dissipation, it is advantageous for an ignition surface carrier oriented radially through the slot into the inside of the chamber to branch off from the portion extending in parallel to and outside the wall, and/or for a connecting part extending in the direction of the longitudinal axis of the spark plug, following the circumferential course of the wall and partially closing the slot to branch off toward the combustion chamber, possibly ending there in the same plane as the front surface of the wall, and/or for the portion of the ground electrode branching off from the ground electrode carrier to be located outside the circumferential region of the wall before the slot. The wall being thus exposed, it can be better cooled by the gas to be combusted.

In a preferred embodiment, provision is made for the center electrode to have a number of electrodes branching off radially outward and made to be centrically symmetric, having in the respective end part thereof an ignition surface facing an ignition surface of a ground electrode, respectively. Simplified manufacturing and accurate ignition performance are obtained if a peripheral annular groove is made following the insulator-side end of the ignition surfaces of the center electrode.

One advantageous embodiment of the end part provides for the end part placed on the end region of the spark plug housing to be configured in the form of a cylinder ring and arranged centrically to the longitudinal axis of the spark plug, extending the spark plug housing in the form of an intermediate piece on the combustion chamber side, and/or for the end part with the end region thereof on the combustion chamber side to surround the base region of the center electrode.

A construction with a simple and fail-safe design will result when the end part is connected to the spark plug housing by welding and/or screwing, and/or when the end part surrounds the base of the center electrode and the insulating body while creating clearance.

FIG. 1 shows a schematic longitudinal section through an embodiment of an inventive spark plug.

Figure 2A:
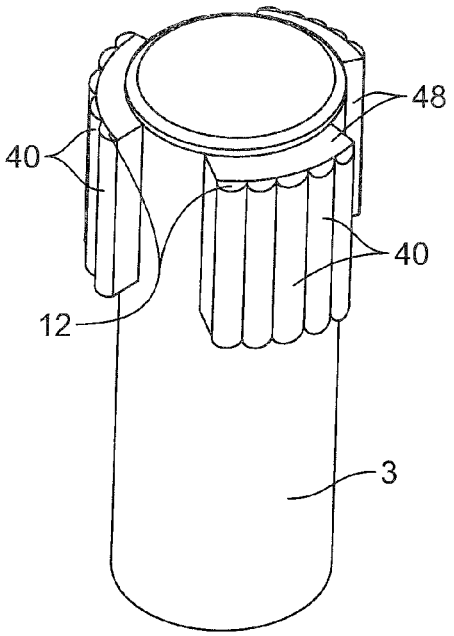
Figure 2B:
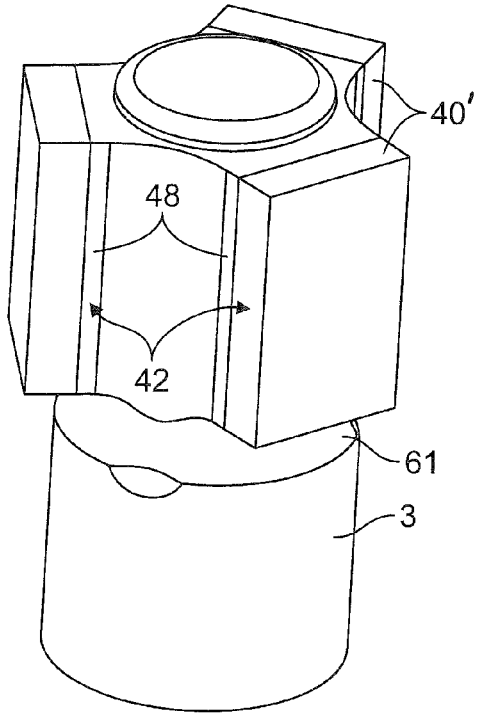

FIGS. 2*a* and 2*b* show embodiments of a center electrode.

Figure 3:
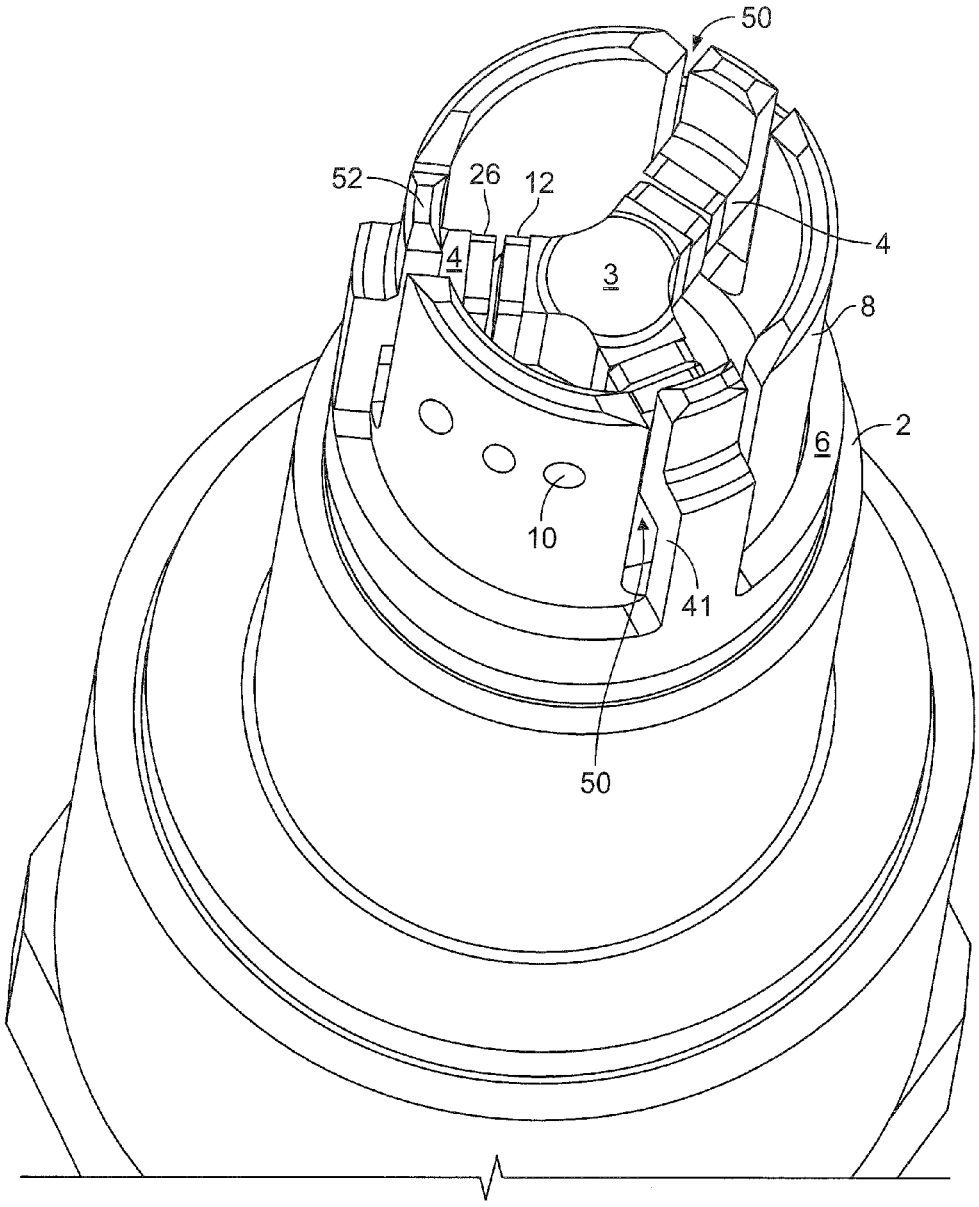

FIG. 3 shows a perspective view of an inventive spark plug.

Figure 4C:
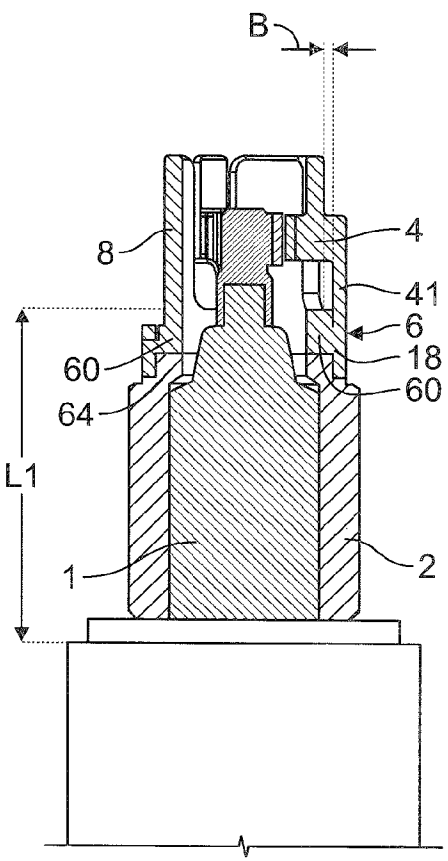
Figure 4B:
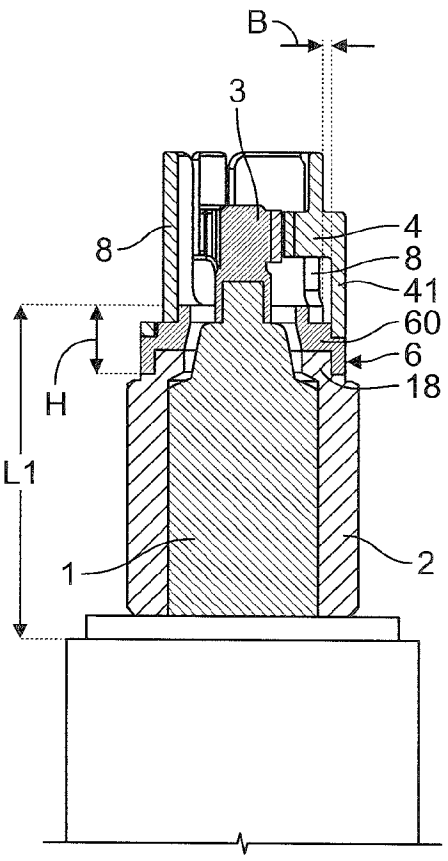
Figure 4A:
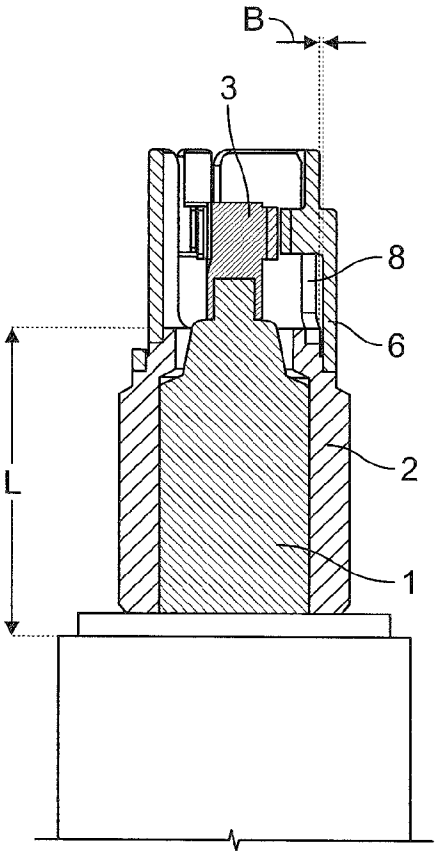

FIG. 4*a* shows a possible embodiment of the inventive spark plug according to FIG. 1. FIG. 4*b* shows an embodiment of a spark plug with an end part placed thereon. FIG. 4*c* shows an inventive spark plug with an end part placed thereon which is made integrally with the wall of the chamber, with the ground electrode carrier being welded to this end part.

Hereafter, the invention will be explained more in detail by way of example with reference to the drawing.

FIG. 1 shows a spark plug for use in an internal combustion engine, in particular for a spark-ignition gas engine. An insulating body 1 carries a spark plug housing 2, with the insulating body 1 surrounding a base center electrode 3*a*, or the electrode branching off therefrom. On this base center electrode 3*a* of the spark plug, the center electrode 3 having at least one ignition surface 12 is placed.

For making at least one spark gap 13, at least one ground electrode 4 supported by a ground electrode carrier 6 is provided. Advantageously, the ground electrodes 4 are distributed on the ground electrode carrier 6 evenly spaced with respect to each other around the center electrode 3. The ground electrode carrier 6 is supported by the spark plug housing 2 or secured thereto.

As apparent from FIG. 1, the ground electrodes 4 respectively branch off from the ground electrode carrier 6 in the form of a finger having a portion 41 and are secured, preferably welded, to the carrier 6. If desired, the ground electrode 4 and the carrier 6 can be made as an integral component. The end region on the combustion chamber side or the ignition surface 26 of the ground electrode 4 are located on an ignition surface carrier 51 and extend in parallel to the longitudinal axis A of the spark plug or in parallel to the facing ignition surface 12 of the center electrode 3. The spark gap 13 is created between the mutually facing ignition surfaces 26, 12 of the ground electrode 4 and the center electrode 3. Said ignition surfaces 26, 12 can preferably be plated with noble metal or noble metal alloys in the form of strips or plates.

For securing the ground electrode carrier 6 to the spark plug housing 2, provision is made for the spark plug housing 2 to have two concentrically located, cylindrical end shoulders 17, 18, the interior end shoulder 17 of which projects from the exterior end shoulder 18 toward the combustion chamber. The ground electrode carrier 6 is placed, slipped, or screwed, and/or if desired secured by welding, in particular spot or seam welding, to the exterior end shoulder 18, and a wall 8 creating a chamber 5 open on the combustion chamber side is thus secured to the interior end shoulder 17. The inner dimensions of the wall 8 and the ground electrode carrier 6 match the respective outer dimensions of the end shoulders 17, 18. The wall 8 forms a screen or shield, and the inventive spark plug can also be designated as a shielding spark plug.

The ground electrode carrier 6 and, in particular the portion 41 of each of the ground electrodes 4 branching off from the carrier, are spaced apart from the outer surface 7 of the wall 8 of the chamber 5, if necessary arranged opposite the center electrode 3 with an offset downward in the direction of the spark plug housing 2. This clearance is provided so as to guarantee defined or unbiased current conduction in the ground electrode carrier 6. Also, as already mentioned above, clearance 21 allows for discrete or defined heat dissipation from the ground electrodes 4 to the spark plug housing 2.

In FIG. 1, a spark plug with a cylindrical wall 8 is represented circumferentially surrounding the center electrode 3. It is also possible to provide variations of the shape of such walls or chambers.

Simple construction and simple manufacturing will result if the walls 8 of the whirl chamber 5 open on the combustion chamber side and the ground electrode carrier 6 have a cross-section at least locally in the form of a circular ring, or are respectively formed by a cylinder ring.

In the wall 8, through-openings 10 can be made for the passage of gas.

Each finger-shaped ground electrode 4 is advantageously bent away from the ground electrode carrier 6 while creating a portion 41 extending in parallel to the wall 8 toward the center electrode 3 in the form of an ignition surface carrier 51 and ends before the center electrode 3. For this purpose, slots 50 are made in the wall 8. The width of such slots 50 substantially corresponds to the width of the portion 41 or slightly exceeds said width. Such slots 50 substantially extend over the entire height of the wall 8, i.e. they start in particular from a region of the wall 8 located approximately at the level of the front surface of the spark plug housing 2, and end at the front surface of the wall 8 on the combustion chamber side. The bent and radially extending ignition surface carrier 51 of the ground electrode 4 extends through said slot 50 toward the center electrode 3. The ignition surface carrier 51 extending from the portion 41 radially through the slot 50 into the inside of the chamber 5 is followed by a connecting part 52 extending in parallel to or in the direction of the longitudinal axis A of the spark plug. The connecting part 52 follows the circumferential course of the wall 8 and closes the slot 50 at least partially in this region or is preferably located inside the slot 50. Said connecting part 52 branches off from the ignition surface carrier 51 toward the combustion chamber and ends at the front surface of the wall 8 and contributes to controlled gas circulation.

As apparent from FIGS. 2 and 3, the center electrode 3 has three ignition surfaces 12 arranged to be centrically symmetric and respectively facing one ignition surface 26 of a ground electrode 4.

On the radially outward facing surface areas 12 of the center electrode 3 and/or on the surfaces 26 facing the center electrode 3 of the respectively opposite ground electrodes 4, adjacent strips 40 made of a noble metal alloy can be applied or melted on. Instead of directly applied or melted on noble metal alloy strips 40, according to FIG. 2*a*, the noble metal alloy can also be applied or welded or melted on projecting regions 48 of the cylindrical part of the center electrode 3 in the form of noble metal plates 40', said regions 48 being formed by welded or integrally formed ridges. Also, on the ground electrodes 4, such raised regions 48 can be made or attached onto which the noble metal alloy, possibly in the form of noble metal plates, is applied or welded or melted. On the side of the ignition surfaces 12 away from the combustion chamber, or directly under the ridges 48 of the center electrode 3, a peripheral annular groove 61 can be made. Said annular groove 61 is a defined limit to the ignition surfaces 12 and facilitates welding or applying of noble metal plates and/or strips 40, 40'.

The wall 8 of the chamber 5 and/or the ground electrodes 4 and/or the ground electrode carrier 6 are made of a nickel base alloy and/or high-temperature special steel and/or hot corrosion-resistant metal alloys with good heat conductivity; the wall 8 can also be made of brass.

For manufacturing and operation of the spark plugs, it appears to be advantageous for the number of ground electrodes 4 to be uneven or for the ground electrodes 4 not to be facing each other with respect to the center axis of the center electrode 3. Thereby, application of noble metal alloys on the ground electrodes 4 branching off from the carrier 6 can be done easily.

The provided slot 50 facilitates required maintenance work or adjustments.

The ground electrode carrier 6 and the wall 8 of the chamber 5 are connected to the spark plug housing 2 in an electrically conductive manner. The center electrode 3 is connected to the base center electrode 3*a* of the spark plug preferably by welding; the base center electrode 3*a* is guided inside the insulating body 1 and electrically insulated with respect to the spark plug housing 2 by the insulating body 1.

The ground electrodes 4 are configured so that the portion 41 is extending substantially straight and without any bend in parallel to the wall 8, and preferably has a cross-sectional shape remaining unchanged over this longitudinal extension. The transition from the ground electrode carrier 6 to the portion 41 can extend in a rounded manner.

In FIG. 4*a*, a spark plug is represented, as represented and described in detail in FIG. 1. L designates the length of spark plug housing 2, with the ground electrode carrier 6 being mounted or in particular secured by welding at the end region on the combustion chamber side of the spark plug 2, and the wall 8 being secured on corresponding shoulders 17, 18 of the spark plug housing 2. In the embodiment of the spark plug according to FIG. 4*b*, an end part 60 in the form of a spacer ring is placed on the end region on the combustion chamber side of the spark plug housing 2, e.g. mounted or screwed, and if desired secured by spot or seam welding. Said end part 60 is meant for extending the spark plug housing 2. Said end part supports a shoulder 18 to which the ground electrode carrier 6 is secured by being placed, screwed, and/or welded thereon, and moreover carries a shoulder 17 supporting the wall 8. As a result, a length L1 of the spark plug housing 2 and the end part 60 placed thereon is obtained which is greater than the length L. Thus, the parts required for ignition, i.e. the ground electrode 4 and the wall 8, can be configured to be shorter and the clearance B between the wall 8 and the shaft 41 of the ground electrode can be configured to be larger. Thereby, heat dissipation and ignition reliability are improved.

In the embodiment of the spark plug according to FIG. 4*c*, the wall 8 is made integrally with the end part 60 secured to the end region on the combustion chamber side of the spark plug housing 2. For this purpose, a shoulder 64 can be made on the spark plug housing, onto which the end part 60 is mounted or screwed, or possibly secured by seam or spot welding. The ground electrode carrier 6 is placed, in particular welded, on the end part 60. The ground electrode carrier 6 can be placed on a shoulder 18 of the end part 60 and fixed in place by welding.

The dark arrows oriented toward the longitudinal axis A of the spark plug represent possible welding seams or welding spots whereby the end part 60 and/or the ground electrode carrier 6 and/or the wall 8 can be welded to said respective supporting components.

It is also possible to provide other types of fastening the end part 60 to the spark plug housing 2 or for the wall 8 and/or the ground electrode carrier to the end part 60 and/or to the spark plug housing 2, e.g. pressing. At any rate, the end part 60 will not be placed on the tapered insulating body. For insulation purposes, these parts must be spaced apart.

The term integral is above all to mean that the or the respective component(s) do not have any welding or brazing connection and is/are formed of the same material or is/are available as a single non composite part or formed from the same component.

A closed chamber 5 is to designate a pre-chamber having a wall 8 and a cover surface with passage openings for combustion gas, bridging or surrounding the space with the electrodes 3,4 and having the required slots (50) for the passage of the ignition surface carrier 51.

The invention claimed is:

1. A spark plug of an internal combustion engine, preferably for spark-ignition gas engines, comprising a spark plug housing (2) surrounding an insulating body (1) and a center electrode (3) and at least one ground electrode (4) supported by a ground electrode carrier (6), wherein the ignition surface (12) of the center electrode (3) and the ignition surface (26) of the ground electrode (4) are surrounded by a wall (8) forming a chamber (5) open or closed on the combustion chamber side, characterized in that the ground electrode carrier (6), as viewed perpendicularly to the longitudinal axis (A) of the spark plug (2), is spaced further apart from the center electrode (3) than it is from the outer surface (7) of the wall (8) of the chamber (5), and supports at least one finger-shaped ground electrode (4) extending into the chamber (5) through an opening (50) in the wall (8), wherein the ignition surface (26) of the ground electrode (4) lies at the same height as the ignition surface (12) of the center electrode (3) in the chamber (5).

2. The spark plug according to claim 1, characterized in that the ground electrode carrier (6) and the wall (8) are supported by the spark plug housing (2) or by an end part (60) arranged at an end region on the combustion chamber side of the spark plug housing (2).

3. The spark plug according to claim 1, characterized in that at the spark plug housing (2) or on the end part (60), two concentrically located, cylindrical end shoulders (17, 18) are formed, the interior end shoulder (17) of which possibly projects from the exterior end shoulder (18) toward the combustion chamber, wherein the ground electrode carrier (6) is placed, slipped, or screwed on, and/or secured by welding, possibly spot or seam welding, to the exterior end shoulder (18), and the wall (8) of the chamber (5) on the interior end shoulder (17), respectively.

4. The spark plug according to claim 1, characterized in that the end part (60) is made integrally with the wall (8), wherein the ground electrode carrier (6) is placed, slipped, or screwed on the end part (60) and/or the spark plug housing (2) and/or secured thereto by welding, possibly spot or seam welding.

5. The spark plug according to claim 1, characterized in that the spark plug housing (2) near the base of the wall (8) is closer to the combustion chamber side end of the spark plug than the ground electrode carrier (6).

6. The spark plug according to claim 1, characterized in that the ground electrode carrier (6) and/or the wall (8), in a section perpendicular to the longitudinal axis (A) of the spark plug, has/have a cross-section which is at least partially in the form of a circular ring or formed by a cylinder ring.

7. The spark plug according to claim 1, characterized in that the at least one ground electrode (4) and the ground electrode carrier (6) are made integrally or connected together by welding.

8. The spark plug according to claim 1, characterized in that through-openings (10) are made in the wall (8) for the passage of gas.

9. The spark plug according to claim 1, characterized in that the ground electrode carrier (6) supports one, three, or five ground electrodes (4), and/or that the ground electrodes (4) are distributed on the ground electrode carrier (6) evenly spaced with respect to each other around the center electrode (3), and/or that each of the ground electrodes (4) branching off from the ground electrode carrier (6) has at least in partial regions of the longitudinal extension thereof a cross-section in the form of a rectangle or cylinder ring section in a portion (41).

10. The spark plug according to claim 1, characterized in that the spark gap (13) is made between surface areas of the ground electrode (4) and the center electrode (3) extending in parallel to the longitudinal axis (A), facing each other, forming the ignition surfaces (12, 26), possibly having a noble metal or noble metal alloy coating.

11. The spark plug according to claim 1, characterized in that on both concentrically located end shoulders (17, 18) of the spark plug housing (2) or the end part (60), respectively one external thread, and on the inner wall surface (19) of the wall (8) and on the inner wall surface (20) of the ground electrode carrier (6), respectively one internal thread matching the respective external thread is made, and/or that the ground electrode carrier (6) and the wall (8) are arranged concentrically with respect to each other while creating a specified radial clearance (21) or offset, and/or that the wall (8) and the ground electrode carrier (6) are slipped on the respective end shoulder (17, 18) and secured thereto by welding.

12. The spark plug according to claim 1, characterized in that in the wall (8), a number of slots (50) is made extending in the longitudinal direction of the spark plug or in parallel to the direction of the longitudinal axis (A) of the spark plug, by which the ground electrodes (4) are guided into the chamber (5), the slots (50) possibly extending from the combustion chamber side front surface of the wall (8) to the level area of the front side of the interior end part (17) or the front side of the end part (60).

13. The spark plug according to claim 1, characterized in that the portion (41) branching off from the ground electrode carrier (6) of the respective ground electrode (4) is located outside the circumferential region of the wall (8) in the area located before the respective slot (50) and/or oriented in parallel to the longitudinal axis (A) of the spark plug.

14. The spark plug according to claim 1, characterized in that from the portion (41) of the ground electrode (4), preferably extending in parallel to and outside the wall (8), an ignition surface carrier (51) preferably going radially through the slot (50) into the inside of the chamber (5) branches off and supports welded or melted on noble metal or noble metal alloy plates if desired.

15. The spark plug according to claim 1, characterized in that from the portion (41), in particular from the ignition surface carrier (51), a connecting part (52) preferably extending in the longitudinal direction of the spark plug or in parallel to the longitudinal axis (A), following the circumferential course of the wall (8) and partially closing the slot (50) and/or at least partially located inside the slot branches off toward the combustion chamber and possibly ends in the same plane as the front surface of the wall (8).

16. The spark plug according to claim 1, characterized in that the center electrode (3) has a number of electrodes branching off radially outward, made to be centrically symmetric and having an ignition surface (12) in the respective end region thereof, respectively opposite an ignition surface (26) of a ground electrode (4).

17. The spark plug according to claim 1, characterized in that a peripheral annular groove (61) is formed following the insulator-side end region of the ignition surfaces (12) of the center electrode (3) or the electrodes.

18. The spark plug according to claim 2, characterized in that the end part (60) placed on the end region of the spark plug housing (2) is configured in the form of a rotationally symmetric cap or in the form of a cylinder ring and arranged centrically to the longitudinal axis (A) of the spark plug, and extends the spark plug housing (2) in the form of an extension or spacer piece on the combustion chamber side.

19. The spark plug according to claim 2, characterized in that the base region of the center electrode (3) is surrounded by the end part (60) with the combustion chamber side end region thereof.

20. The spark plug according to claim 2, characterized in that the end part (60) is connected to the spark plug housing (2) by welding and/or screwing.

* * * * *